US011338171B2

(12) United States Patent
Howett et al.

(10) Patent No.: US 11,338,171 B2
(45) Date of Patent: May 24, 2022

(54) EXERCISE APPARATUS

(71) Applicants: Robert Victor Howett, Bershire (GB); Raymond Lewis McCallum, London (GB)

(72) Inventors: Robert Victor Howett, Bershire (GB); Raymond Lewis McCallum, London (GB)

( * ) Notice: Subject to any disclaimer, the term of this patent is extended or adjusted under 35 U.S.C. 154(b) by 23 days.

(21) Appl. No.: 16/646,865

(22) PCT Filed: Sep. 14, 2018

(86) PCT No.: PCT/GB2018/052622
§ 371 (c)(1),
(2) Date: Mar. 12, 2020

(87) PCT Pub. No.: WO2019/053448
PCT Pub. Date: Mar. 21, 2019

(65) Prior Publication Data

US 2020/0276470 A1 Sep. 3, 2020

(30) Foreign Application Priority Data

Sep. 15, 2017 (GB) ..... 1714845

(51) Int. Cl.
*A63B 22/00* (2006.01)
*A63B 21/00* (2006.01)
(Continued)

(52) U.S. Cl.
CPC ..... *A63B 22/0005* (2015.10); *A63B 21/0058* (2013.01); *A63B 21/00069* (2013.01);
(Continued)

(58) Field of Classification Search
CPC ..... A63B 22/0005; A63B 21/4035; A63B 21/00069; A63B 21/0058; A63B 21/0084;
(Continued)

(56) References Cited

U.S. PATENT DOCUMENTS 5,580,338 A * 12/1996 Scelta ..... A63B 22/0002 482/114
5,916,065 A * 6/1999 McBride ..... A63B 22/0664 482/57
(Continued)

FOREIGN PATENT DOCUMENTS

KR 20020080061 A * 10/2002
WO 2012105902 A1 8/2012

OTHER PUBLICATIONS

International Search Report and Written Opinion filed in PCT/GB2018/052622 dated Jan. 2, 2019; 18 pages.

*Primary Examiner* — Garrett K Atkinson
*Assistant Examiner* — Kathleen M Fisk
(74) *Attorney, Agent, or Firm* — Vedder Price P.C.

(57) ABSTRACT

The present disclosure relates to an exercise apparatus. More particularly, the present disclosure relates to an apparatus operated by hand which comprises a base upon which extend frame supports for the seat unit, resistance unit, crank unit, and guide unit. Embodiments provide for a crank to be mounted to the base and frame and wherein the crank is connected to first and second actuating rods via a coupling. The actuating rods are slidably connected at one end via a guide pivotally mounted to the frame and have a free end for a user to grip.

28 Claims, 12 Drawing Sheets

(51) Int. Cl.

| | |
|---|---|
| ***A63B 21/005*** | (2006.01) |
| ***A63B 21/008*** | (2006.01) |
| ***A63B 21/22*** | (2006.01) |
| ***A63B 71/06*** | (2006.01) |
| ***A63B 22/06*** | (2006.01) |

(52) U.S. Cl.
CPC ..... *A63B 21/0084* (2013.01); *A63B 21/0088* (2013.01); *A63B 21/00192* (2013.01); *A63B 21/225* (2013.01); *A63B 21/4035* (2015.10); *A63B 22/0664* (2013.01); *A63B 71/0619* (2013.01); *A63B 22/0002* (2013.01); *A63B 2022/067* (2013.01); *A63B 2208/0233* (2013.01); *A63B 2225/09* (2013.01)

(58) Field of Classification Search
CPC ..... A63B 21/0088; A63B 21/225; A63B 71/0619; A63B 2022/067; A63B 2208/0233; A63B 23/03541; A63B 2208/0204; A63B 2225/09; A63B 22/0015; A63B 22/205; A63B 21/015; A63B 21/00192; A63B 21/005–0052; A63B 21/0056–0059; A63B 21/012–015; A63B 21/02; A63B 21/022–028; A63B 21/045–0455; A63B 21/22–227; A63B 22/0002–0005; A63B 22/0025; A63B 22/0048; A63B 22/06; A63B 22/0664; A63B 2022/002; A63B 2022/0035; A63B 2022/0611; A63B 2022/0652; A63B 2022/0682; A63B 23/03516; A63B 23/12; A63B 23/1245; A63B 23/1254; A63B 23/1281
See application file for complete search history.

(56) References Cited

U.S. PATENT DOCUMENTS

| | | | | |
|---|---|---|---|---|
| 5,928,115 | A * | 7/1999 | Arroyo, Jr. ..... | A63B 22/0005 482/62 |
| 6,019,710 | A * | 2/2000 | Dalebout ..... | A63B 22/0664 482/51 |
| 6,135,923 | A * | 10/2000 | Stearns ..... | A63B 22/001 482/51 |
| 6,620,079 | B2 * | 9/2003 | Kuo ..... | A63B 22/001 482/51 |
| 6,786,850 | B2 * | 9/2004 | Nizamuddin ..... | A63B 21/157 482/51 |
| 6,811,517 | B1 * | 11/2004 | Eschenbach ..... | A63B 22/001 482/52 |
| 7,223,209 | B2 * | 5/2007 | Lee ..... | A63B 22/001 482/52 |
| 2002/0137601 | A1 * | 9/2002 | Tobias ..... | A63B 22/001 482/52 |
| 2005/0003934 | A1 * | 1/2005 | Wu ..... | A63B 21/0051 482/64 |
| 2014/0243159 | A1 | 8/2014 | Oblak et al. | |

* cited by examiner

EXERCISE APPARATUS

FIELD OF THE DISCLOSURE

The present disclosure relates to an exercise apparatus. More particularly, the present disclosure relates to an exercise apparatus operated by hand.

BACKGROUND OF THE DISCLOSURE

Numerous machines have been devised to strengthen and condition leg muscles or arm muscles in gymnasia or home use. These machines benefit from being capable of being located indoors, out of the elements, avoiding adverse weather conditions. They have a relatively small footprint, which is advantageous when restrictions on space prohibit many people from being able to conveniently participate in sports, running, walking etc.

Such machines might include, treadmills, stepping machines and elliptical exercise machines which benefit users by helping them to improve their cardiovascular fitness and/or reduce weight. These machines are considered to have a "low impact" on a person's body, as the motion is relatively gentle on the joints and the impact to the body is limited in different ways depending upon the type of machine being used. Consequently, these machines are often considered the best choice for older people, as well as individuals recovering from injury or having a physical impairment.

There are numerous elliptical trainers, such as U.S. Pat. No. 6,726,600, which describes a compact elliptical exercise device that simulates walking and jogging with arm exercise. However, such machines are unsuitable for wheelchair users, for example, or those having little or no lower limb mobility.

SUMMARY OF THE DISCLOSURE

In accordance with a first embodiment of the present disclosure, there is provided an apparatus for exercising comprising: a base and a frame to which is mounted a first crank rotatably mounted on a crank shaft mounted on the frame, said first crank connected to first and second actuating rods, the first crank connected to the first rod via a first coupling rotatably mounted to the first crank, said actuating rods slidably mounted at one end via a coupling pivotally mounted to the frame and having a free end for a user to grip and said actuating rods being in phase with one another such that they follow substantially parallel paths of movement simultaneously during use.

The dual, simultaneous movement of the actuating rods permit a user to grip the free end provides a unique exercise movement and workout.

The apparatus may have a second crank rotatably mounted on the frame, said second crank connected to the second actuating rod via a second coupling rotatably mounted to the second crank.

A seat may be provided for supporting a user in a seated position whilst operating the apparatus. The position of the seat may be altered on the apparatus to facilitate different sized users and to facilitate a user to exercise different muscles to differing degrees. The seat may be moveably mounted such that the seat's vertical height may be adjusted and the seat may be capable of moving longitudinally with respect to the apparatus frame. The seat may be movably mounted on a longitudinal track and its position secured using any suitable means, such as a locking pin cooperating with one or more apertures disposed along a track's length. The seat may be disposed between the cranks.

The direction of displacement of the actuating rods by a user may be generally in a plane perpendicular to the longitudinal axis of the crank shaft. A user in a seated position may displace the actuating rods in a generally vertical plane with respect to the plane of the base, upwardly or downwardly.

The first and second cranks may be located behind the seat, and the coupling for slidably receiving one end of the actuating rods may be located behind the cranks with respect to a seated user. In an embodiment, the user faces away from the cranks and coupling.

The apparatus may further comprise resistance means for imparting resistance to rotation by the cranks. The resistance means may comprise any suitable means for imparting resistance to rotation of the crank shaft, such as, for example, any one or more of a motor, a flywheel, magnetic, electrical and/or mechanical resistance to rotation of the cranks. The resistance means may comprise a torsion spring whose resistance can be varied, webbing which can extend at least partially around the circumference of the flywheel to provide resistance to the rotation of the cranks, and/or one or more blades mountable onto the surface of the wheel to resist rotation by providing resistance against a fluid. The fluid may comprise any one or more of the following: air, liquid or the like.

The exercise apparatus in an embodiment is a hand-operated elliptical trainer.

The apparatus may have a display screen mounted to the frame which may display data relating to the exercise being performed, and one or more physiological metrics of a user.

The movement of the free ends of the actuating rods may be elliptical and are in phase. Each rod of the apparatus may have two handles. The handles may comprise a plurality of grip positions for a user to engage with the apparatus.

Each handle may comprise grip elements minimizing slippage and lift-off of the user's hands.

One or more handles may comprise a controller for controlling a visual display and/or resistance imparted by resistance means. One or more of the handles may further comprise means for measuring the heart rate of a user. The means for measuring the heart rate may comprise one or more contact plates mounted on the handles which a user grips.

In accordance with a further embodiment of the present disclosure, there is provided an apparatus for exercising comprising: a base and a frame to which is mounted first and second cranks rotatably mounted on a crank shaft mounted on the frame, said first and second cranks each connected to first and second actuating rods via first and second couplings each rotatably mounted to the first and second crank, respectively; said actuating rods slidably mounted at one end via a coupling pivotally mounted to the frame and having a free end for a user to grip; and said cranks being in phase such that the actuating rods follow substantially the same path of movement during use.

In accordance with a further embodiment of the present disclosure, there is provided an exercise apparatus comprising at least one wheel, at least one bar pivotably connected to the wheel at one end and pivotably connected at the other end to an actuating member, wherein the actuating member is pivotably mounted and comprises a handle mounted thereto such that movement of the handle is possible whilst the at least one bar is displaced during use, and wherein rotation-opposing means is associated with the wheel to provide variable resistance to the rotation of the wheel.

The apparatus is beneficial for improving cardiovascular fitness and muscular endurance.

The wheel may be magnetic and the rotation-opposing means comprise at least one magnet.

The rotation-opposing means may comprise any one or more of the following: a torsion spring whose resistance can be varied; at least one magnet; one or more resistance bands; an alternator.

The rotation-opposing means may comprise webbing which can extend at least partially around the circumference of the wheel to provide resistance to the rotation of the wheel.

The rotation-opposing means may comprise one or more blades mountable onto the surface of the wheel to resist rotation by providing resistance against a fluid.

The fluid may comprise any one or more of the following: air, liquid or the like.

The rotation-opposing means may comprise means for varying the resistance to rotation.

The exercise apparatus may be a hand-operated elliptical trainer.

The apparatus may comprise two wheels. The wheels may be spaced apart and may operate independently of one another.

The wheels may be mounted on a frame to enable the distance between the wheels to be varied.

The frame may comprise a sliding track and the wheel housings slidably mounted thereon such that their position with respect to one another can be carried.

The apparatus may be used in any suitable orientation. The apparatus may be moveably mounted on a frame to permit the orientation of the handles to be varied according to the position of a user to vary the exercise. The movement of the handles relative to the wheel may be varied to exercise different muscle groups or place emphasis on different muscles during use.

The apparatus may comprise a braking mechanism to enable an operator to slow or arrest the rotation of the wheel. The braking mechanism may be controlled by an actuator. The actuator may be disposed on a handle.

The apparatus may comprise means for controlling the level of resistance to rotation of the wheel by the rotation-opposing means. The means for controlling the level of resistance may be provided in a handle.

The rotation-opposing means may be operatively connected to the handle by a pulley system.

BRIEF DESCRIPTION OF THE DRAWINGS

The present disclosure will now be described, by way of example only, with reference to the accompanying drawings in which.

DETAILED DESCRIPTION OF THE DISCLOSURE

Figure 1:
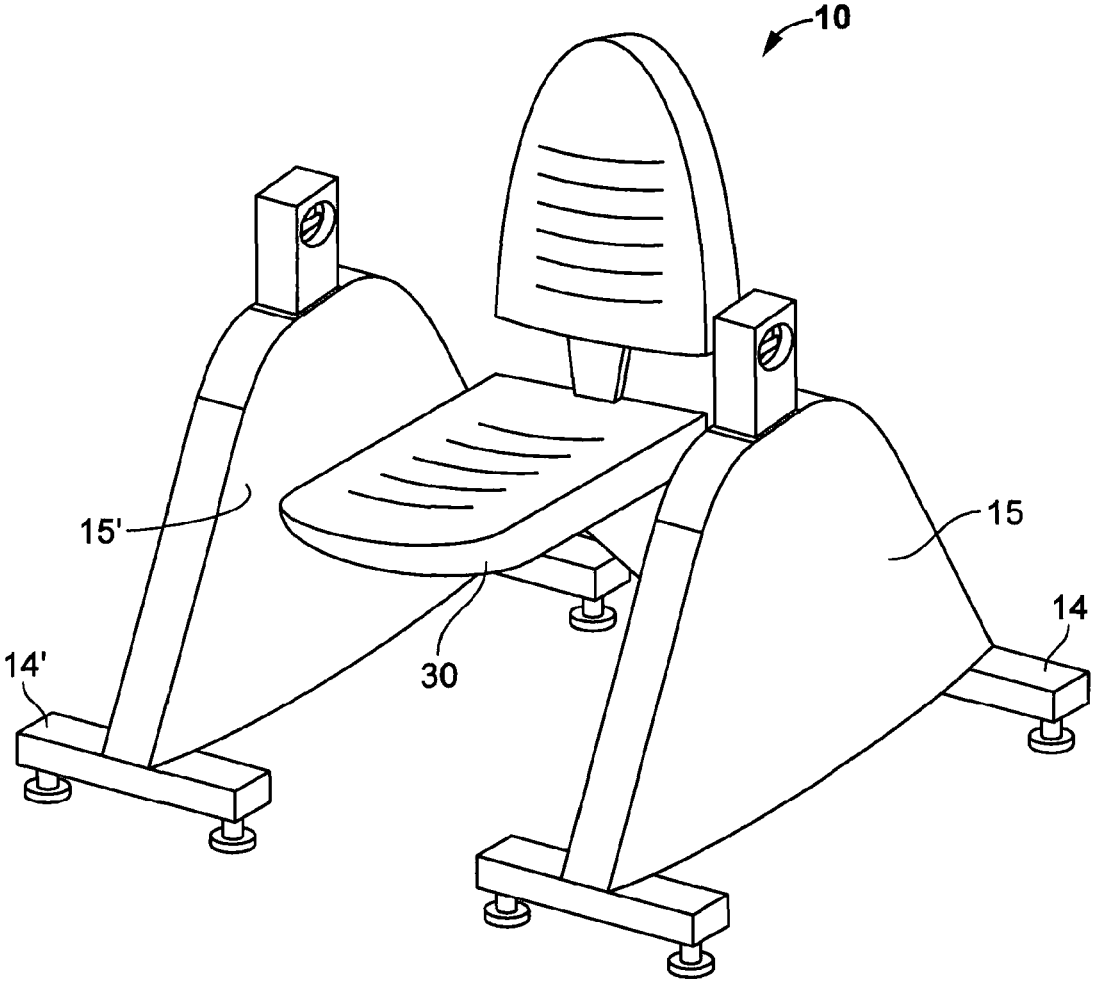
FIG. 1 shows an apparatus in accordance with the present disclosure.
Figure 2A:
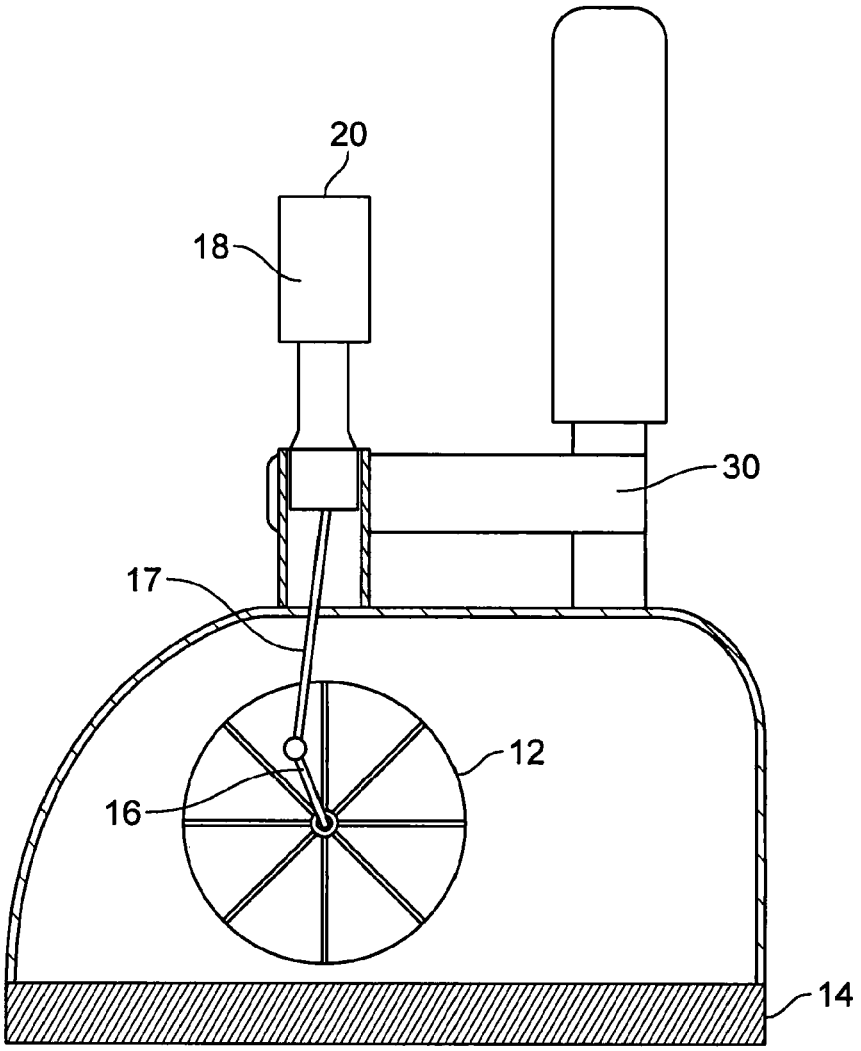
FIGS. 2A and 2B show a device and a handle in accordance with the present disclosure.
Figure 2B:
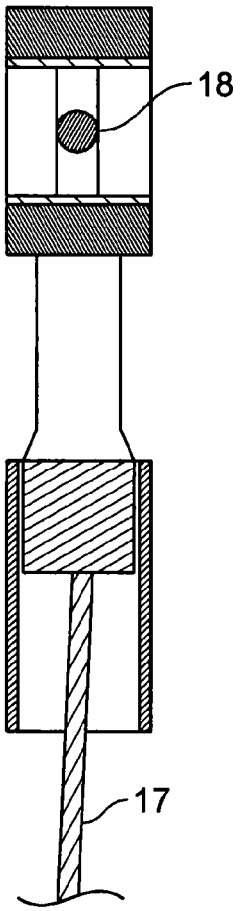

The exercise apparatus 10 has two wheels 12, 12' rotatably mounted to a base 14, 14', spaced apart and each located within a housing 15, 15' respectively. Pivotably connected to the wheel is a cam 16. The other end of cam 16 is pivotably connected to a push rod 17 which is pivotably connected to a handle 18 which is rotatably mounted in a housing 20. Housing 20 is pivotably mounted to the cam 16 such that movement of the arm in a vertical plane up or down by operating on the handle causes an elliptical rotation of the arm relative to the wheel 12.

Disposed between the wheels 12, 12' is a seat 30 for supporting a user's body. The seat is adjustable in its sagittal and transverse plane so that a user may adjust the seat height for optimal position of their hands relative to the body. The adjustment member for height as well as forward or rearward movement comprise a bolt which is biased into an engaged configuration and a shaft having a plurality of apertures each shaped to receive the bolt to lock the position of the seat in either the transverse or sagittal plane.

In an embodiment, the adjustment member may comprise the use of a hydraulic jack. The vertical height can be adjusted electronically or by hand via operating lever.

The handles may comprise grip elements to minimize the slippage and lift-off of the user's hands to maximize the effectiveness of the exercise.

The wheel may be rotated clockwise or counterclockwise, alternatively rearwardly or forwardly respectively relative to the base. Generally, during a downward power stroke on the elliptical exercise machine 10, the user's hand is pushed down against the elliptical exercise machine's resistance and returned upward with minimal to no resistance. Conversely, during an upward power stroke, the user's hand is pushed upward and returned forward with minimal to no resistance. In the downward power stroke, the primary eccentric muscles of the arm and the abdominals are employed and the concentric muscles are relaxed. In the upward power stroke, the concentric muscles of the arm and the abdominals are employed and the eccentric muscles are relaxed.

The apparatus also allows active participation of both eccentric and concentric muscle groups in each downward power stroke and upward power stroke. This is provided by the rotation-opposing means which consists of the magnetic wheel in co-operation with a pair of magnets (not shown) whose resistive effect on the rotation of the wheel can be varied.

Figure 3A:
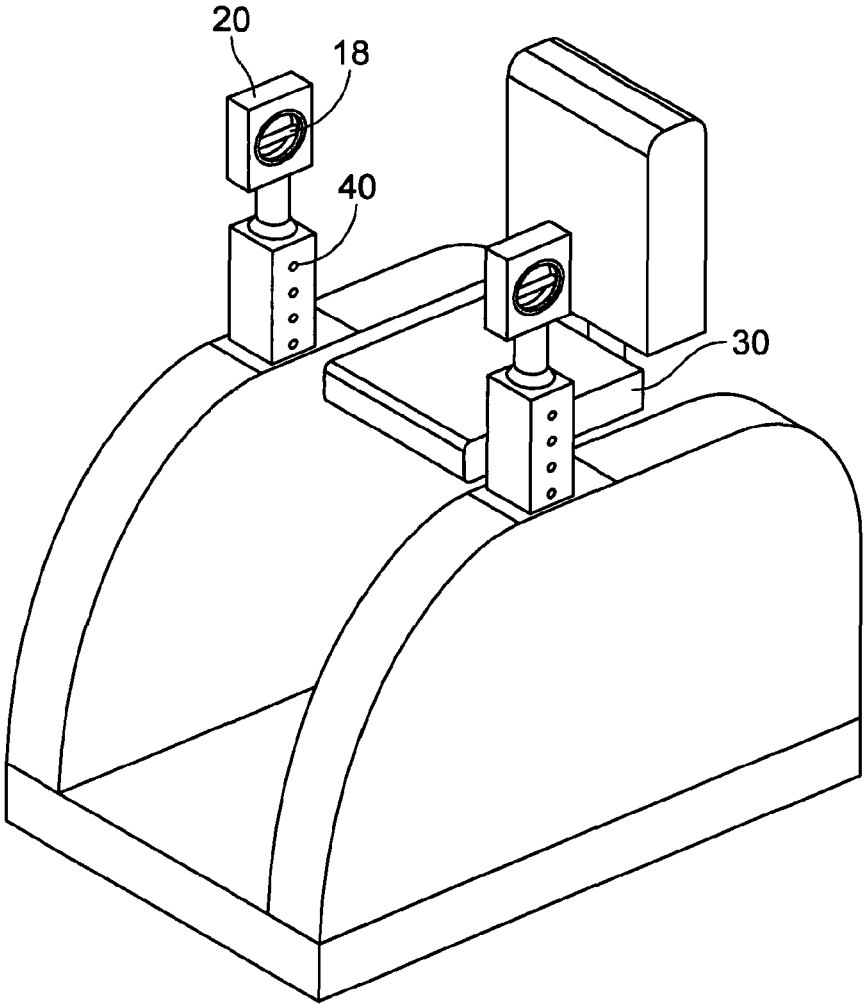
FIGS. 3A and 3B show an alternative embodiment having differing handle orientations in accordance with the present disclosure.
Figure 3B:
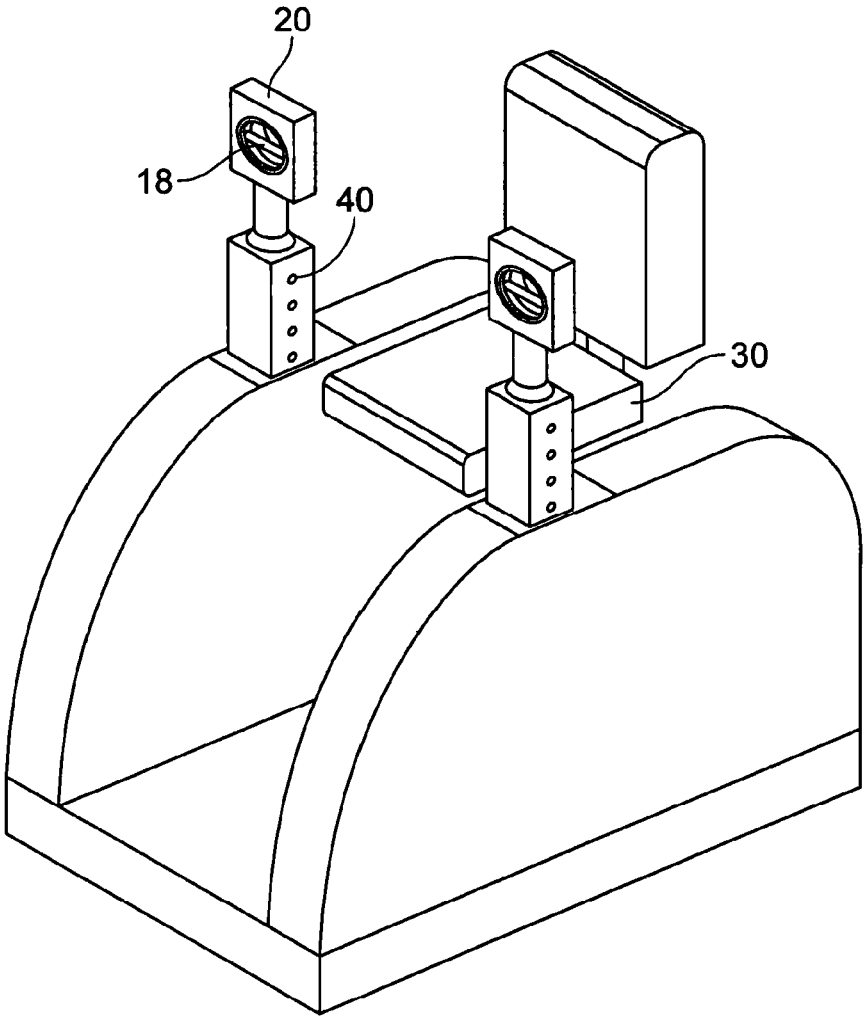
Figure 4A:
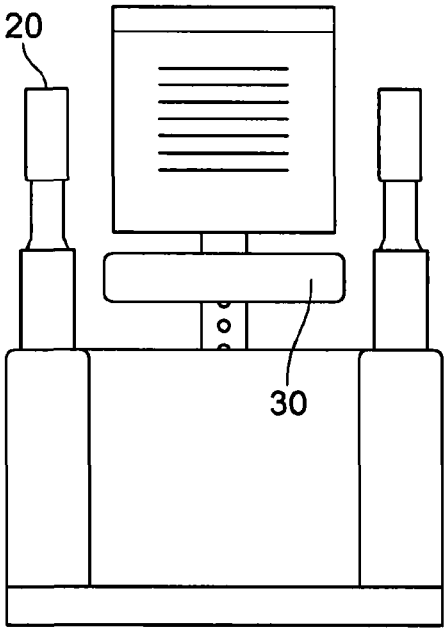
FIGS. 4A and 4B show an alternative embodiment having differing handle orientations in accordance with the present disclosure.
Figure 4B:
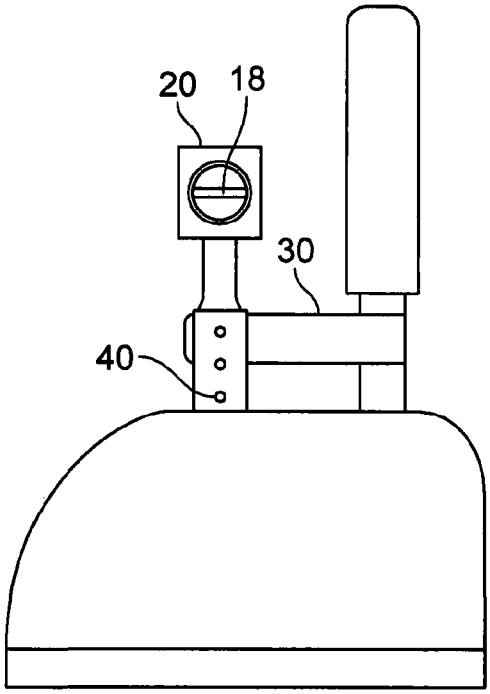
Figure 5A:
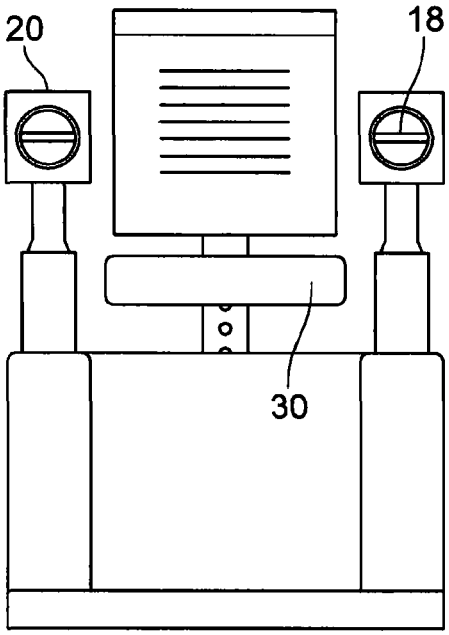
FIGS. 5A and 5B show an alternative embodiment having differing handle orientations in accordance with the present disclosure.
Figure 5B:
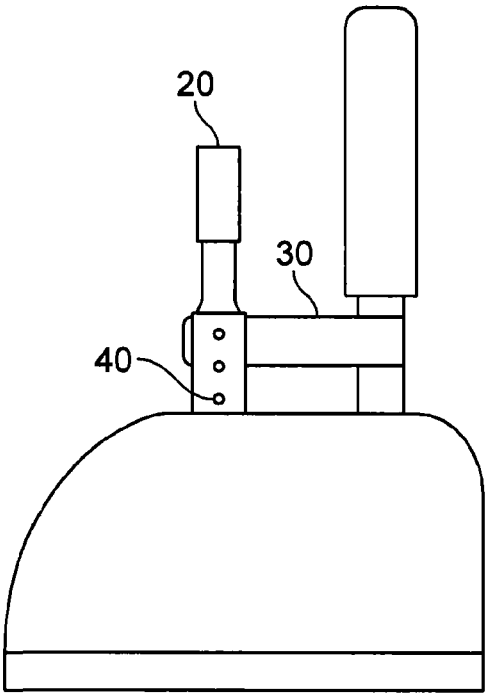

The handles may be orientated as desired to vary the exercise by placing differing loads on different muscles, as shown in FIGS. 3A and 3B.

The handle may be moved up and/or down in a reciprocating fashion to act upon push rod 17. The position of the handles relative to the push rod 17 may be adjusted to accommodate differing vertical handle positions relative to the push rod 17 and the wheel 12 accommodating users having differing heights or to focus the exercise on different muscles.

The handles' position relative to the housing may be adjusted using a removable locking bolt which cooperates with apertures 40.

The apparatus may simply have a platform in an embodiment between the wheels rather than a seat to permit a wheelchair to be accommodated therebetween should a wheelchair user wish to operate the apparatus. The wheelchair can then be locked into position. This may prove beneficial to Paralympians and other wheelchair users. Alternatively, the apparatus may be used while standing.

Figure 6:
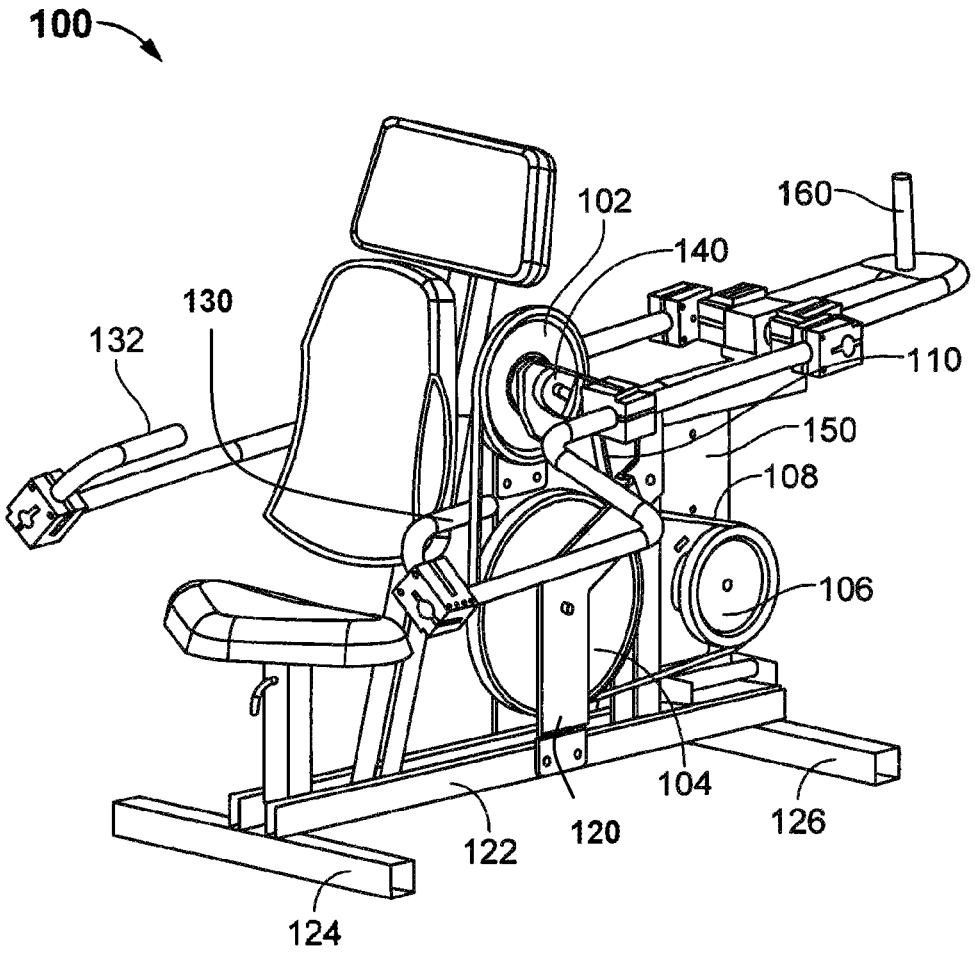
FIG. 6 shows an embodiment in accordance with the present disclosure.
Figure 7:
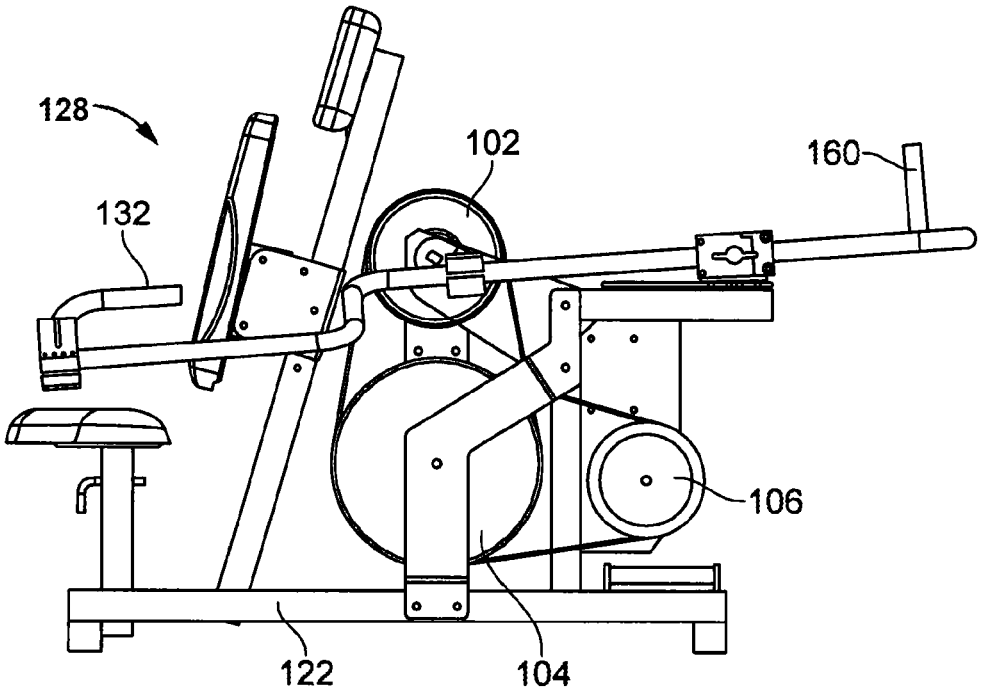
FIG. 7 shows a side elevation of the embodiment shown in FIG. 6.

FIGS. 6 and 7 show an embodiment of the present disclosure. The exercise apparatus 100 has a pulley system comprising first, second and third wheels 102, 104, 106 operably connected to one another by first and second belts 108, 110.

The pulley system is mounted on a frame 120 having a base 122 and two legs 124, 126 on which is mounted a chair 128, whose position is adjustable.

There are two handles 130, 132 connected to either side of the first wheel 102 by means of rods 140 (only one side shown) which is pivotally mounted to the handles and wheel.

The free ends of the handles extend beyond the seat and have on one handle a brake actuator for slowing and ultimately stopping the rotation of the wheels and the other having a controller which adjusts the resistance to rotate the third wheel which is connected to the drive unit 150 which provides the adjustable resistance to rotation of the wheels.

The facility to add a counterbalance is provided by an upstanding rod 160 distally disposed with respect to the handles. The rod received weights having correspondingly shaped apertures through which the rod may extend. The number of weights mounted on the rod can vary according to the resistance required.

Figure 8:
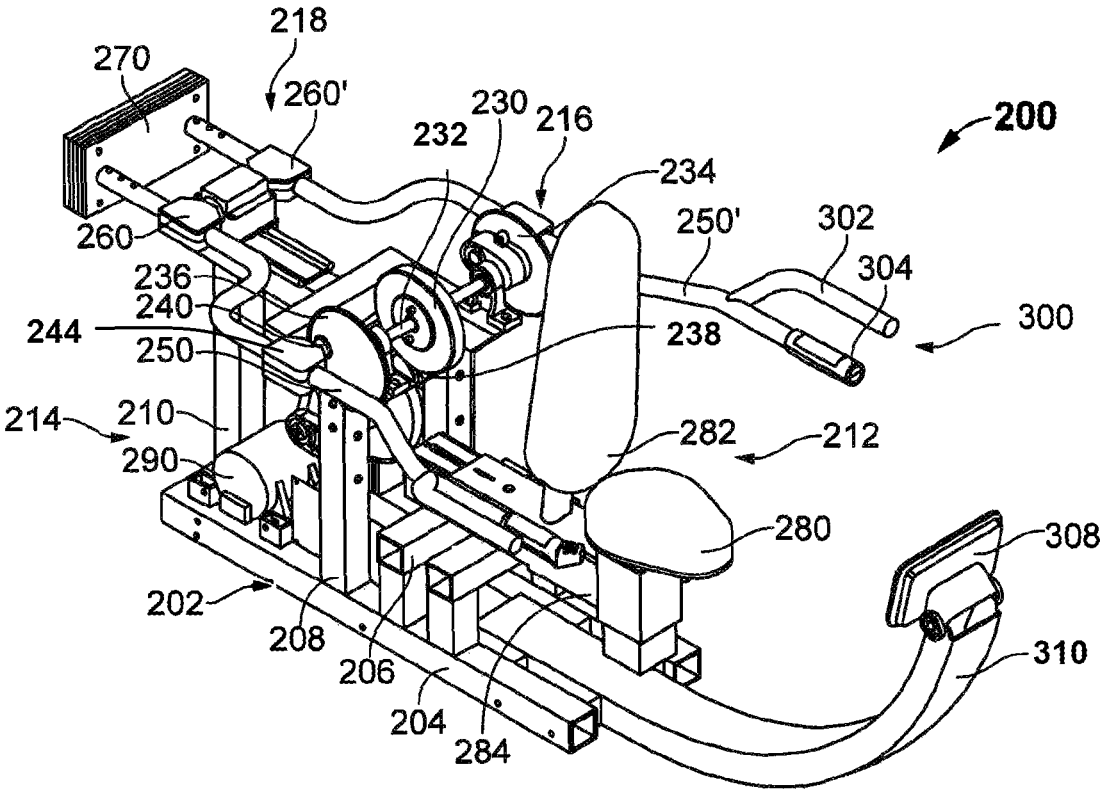
FIG. 8 shows a view of an embodiment from one side in accordance with the present disclosure.
Figure 9:
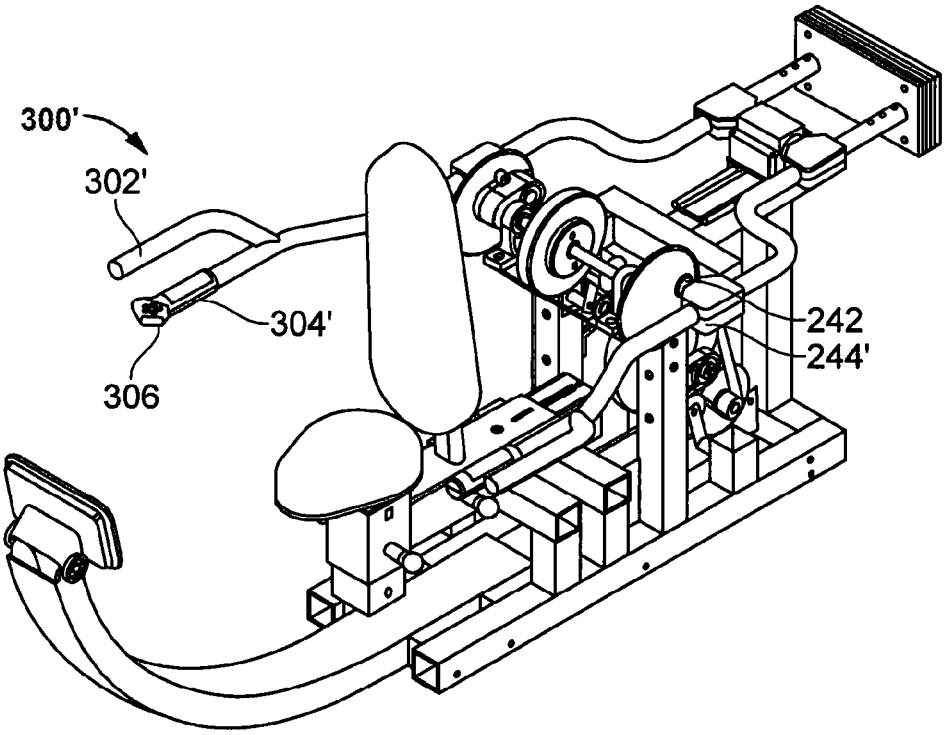
FIG. 9 shows the embodiment of FIG. 8 from the other side.

FIGS. 8 and 9 show apparatus 200 having a frame 202 forming a base 204 upon which extend first, second and third frame supports 206, 208, 210 for the seat unit 212, resistance unit 214 and crank unit 216, and guide unit 218 respectively.

The guide unit 218 is located at the rear of the apparatus, the seat unit 212 at the front and the crank unit 216 and resistance unit 214 located between the two.

The crank unit 216 comprises a fly wheel 230 centrally mounted on a crank shaft 232, either end of which is connected to first 234 and second cranks 236 respectively.

The first and second cranks 234, 236 are rotatably mounted at either end of the crank shaft 232, respectively, and are in phase with one another such that the respective crank anus 240,242 are substantially in the same position relative to one another during the rotation cycle of the crank arms 240, 242.

Each crank arm 240, 242 has a pivotally mounted first and second coupling 244, 244' having a through going aperture whose longitudinal axis is perpendicular to the longitudinal axis of the crank arm 240, 242 and through which first and second transmission rods 250, 250' pass, respectively. The transmission rods are fixed to the couplings.

Located rearwardly of the resistance unit 214 is the guide unit 218 and includes a frame 210 either side of which at its top, free end, are pivotally mounted two guides 260, 260', each having a through going bore for receiving the rearward end of the transmission rods 250, 250'.

The rods 250, 250' are slidably mounted within the guides 260, 260' so that they are able to reciprocate back and forth while the guides themselves are free to pivot. The distal ends of the rods are connected via a counterweight 270.

The seat unit 212 comprises a slidably mounted assembly comprising a seat 280 and a back rest 282 on a seat frame 284 which is capable of translational movement fore and aft with respect to the base 204. The position can be set using a locking pin which is capable of releasably locking the assembly in a desired position.

The seat 280 may be raised or lowered with respect to the back rest to accommodate differing heights in users so that they may adopt the most appropriate position on the apparatus for a particular workout. The position of the seat 280 with respect to the back rest may be releasably locked, again using a locking pin as described above.

The flywheel 230 is operatively connected to the resistance unit by a belt 238 for creating an exercise load that can be varied. The resistance unit 214 is mounted on the base and comprises a motor 290 for varying the resistance exerted on the rotation of the flywheel 230.

The free ends 300, 300' of the transmission rods 250, 250' each comprise bifurcated handles 302, 304 and 302', 304'.

Handles 304, 304' are intelligent handles comprising contact points for measuring the heart rate of a user while gripping the handle if desired, in addition to a controller 306 on handle 304'. Controller 306 has a number of buttons to permit a user to operate the exercise machine and choose workout options, video content displayed and the like on a screen 308 mounted on a supporting arm 310 that is connected to the base 204 and holds the screen 308 at a suitable height for a user to view.

Via the controller and screen, if touch screen technology is employed, a user may choose the load to be exerted to resist movement of the cranks via the handles and transmission rods.

The movement of the handles may follow an elliptical path.

In use, a user adjusts the seat unit for the desired position according to height and arm length. Gripping the handles, a user displaces them generally downwardly or upwardly, depending upon the muscle groups to be exercised. The transmission rods will cause the crank to rotate and for their distal end to slide in guides 260, 260' and reciprocate fore and aft while the guides themselves pivot facilitating the elliptical path followed by the handles at the other end.

As the cranks are in phase, the transmission rods 250, 250' and the handles follow the same path at the same time.

Figure 10:
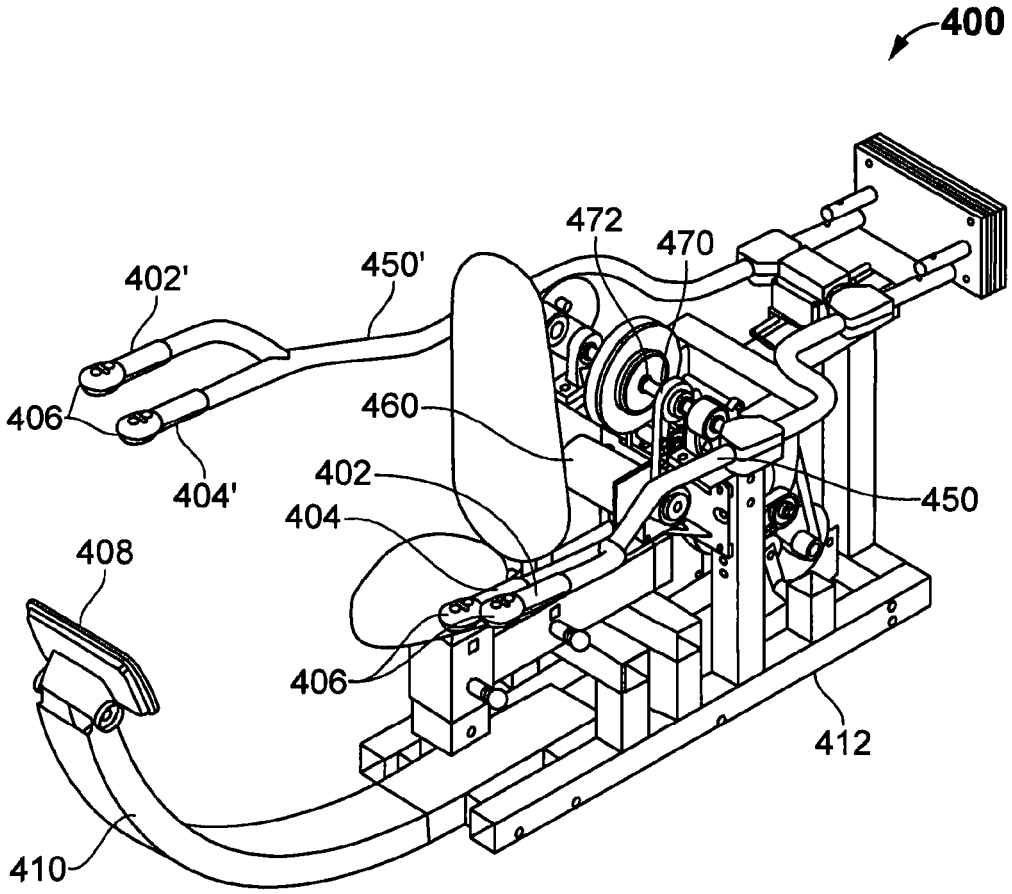
FIG. 10 shows an embodiment in accordance with the present disclosure having means for displacing the handles.

FIG. 10 shows an embodiment 400 differing from the embodiment shown in FIGS. 8 and 9 by having a second motor. The apparatus 400 has handles 402, 402' and 404, 404' which are intelligent handles comprising contact points for measuring the heart rate of a user while gripping the handle if desired, in addition to controllers 406 on each handle. Controllers 406 have a number of buttons to permit a user to operate the exercise machine and choose workout options, video content displayed and the like on a screen 408 mounted on a supporting arm 410 that is connected to the base 412 and holds the screen 408 at a suitable height for a user to view.

Operatively connected to the rods 450, 450' is a motor 460 that is capable of displacing the rods and therefore handles. The motor 460 has a belt 470 operatively connecting it to crank shaft 472 so that by cooperating they are capable of displacing the handles.

This motor 460 displaces the handles into a position suitable for a user to begin or end a workout. For example, a user may wish to begin a workout by pushing the handles and the motor 460 facilitates the appropriate position of the handles for beginning a workout in such a manner. Alternatively, a user may wish to begin by pulling the handles, in which case the motor 460 again facilitates the displacement of the handles into the desired position. The motor 460 is operated by the controllers 406 and/or screen 408.

Predetermined start and/or finishing positions can be set on screen 408 using the screen 408 and/or controllers 406.

In an embodiment, a user presses a normally open switch to power the motor 460 displacing the handles.

From the foregoing description, it should be appreciated that apparatus and methods for providing introduction for the purpose of enhancing cardiovascular exercise activity is provided and presents significant benefits that would be apparent to one skilled in the art. Furthermore, while multiple embodiments have been presented in the foregoing description, it should be appreciated that a vast number of variations in the embodiments exist. Lastly, it should be appreciated that these embodiments are preferred exemplary embodiments only and are not intended to limit the scope, applicability or configuration of the disclosure in any way. Rather, the foregoing detailed description provides those skilled in the art with a convenient road map for implementing a preferred exemplary embodiment of the disclosure, it being understood that various changes may be made in the function and arrangement of elements described in the exemplary preferred embodiment without departing from the spirit and scope of the disclosure as set forth in the appended claims.

The invention claimed is:

1. An apparatus for exercising comprising:

a base and a frame, a first crank rotatably mounted on a crank shaft mounted on the frame, said first crank connected to a first actuating rod, the first crank connected to the first actuating rod via a first coupling rotatably mounted to the first crank, a second actuation rod;

each of said first and second actuating rods being slidably mounted at one end via a respective one of a pair of guides pivotally mounted to the frame and having a free end configured for a user to grip, said first and second actuating rods being in phase with one another such that they follow parallel paths of movement simultaneously during use; and wherein each of said first and second actuating rods slide through the guides as the actuating rods are displaced along the path of movement.

2. The apparatus as claimed in claim 1 further comprising a second crank rotatably mounted on the frame, said second crank connected to the second actuating rod via a second coupling rotatably mounted to the second crank.

3. The apparatus as claimed in claim 2 further comprising resistance means for imparting resistance to rotation by the first and second cranks.

4. The apparatus as claimed in claim 3 wherein the resistance means comprises magnetic, electrical and/or mechanical resistance to rotation of the first and second cranks.

5. The apparatus as claimed in claim 4 wherein the resistance means comprises one or more blades mountable onto the surface of a wheel to resist rotation by providing resistance against a fluid.

6. The apparatus as claimed in claim 5 wherein the fluid comprises any one or more of the following: air or liquid.

7. The apparatus as claimed in claim 4 wherein the resistance means comprises means for varying resistance to rotation.

8. The apparatus as claimed in claim 7 wherein the apparatus is a hand-operated elliptical trainer.

9. The apparatus as claimed in claim 4 wherein the resistance means comprises a torsion spring, wherein a resistance of the torsion spring is configured to be varied.

10. The apparatus as claimed in claim 4 wherein the resistance means comprises webbing that is configured to extend at least partially around a circumference of a flywheel to provide resistance to the rotation of the first and second cranks.

11. The apparatus as claimed in claim 3 wherein the resistance means comprises a motor.

12. The apparatus as claimed in claim 3 wherein a flywheel is mounted on the crank shaft and is operatively connectable to a motor.

13. The apparatus as claimed in claim 2 further comprising a seat configured for supporting a user in a seated position.

14. The apparatus as claimed in claim 13 wherein the seat's vertical height to be adjusted.

15. The apparatus as claimed in claim 14 wherein the seat is moveably mounted and is configured to be moved along longitudinal plane with respect to the apparatus.

16. The apparatus as claimed in claim 13 wherein the first and second actuating rods are configured to be displaced by the user in a seated position in a vertical plane with respect to a plane of the base, upwardly or downwardly.

17. The apparatus as claimed in claim 13 wherein the first and second cranks are located behind the seat, and wherein the pair of guides for slidably receiving one end of the first and second actuating rods is configured to be located behind the first and second cranks with respect to the seated user.

18. The apparatus as claimed in claim 13, wherein the apparatus is configured such that the user faces away from the first and second cranks and the pair of guides.

19. The apparatus as claimed in claim 2 further comprising a seat disposed between the first and second cranks.

20. The apparatus as claimed in claim 1 further comprising two handles.

21. The apparatus as claimed in claim 20 wherein the two handles comprise a plurality of grip positions configured for the user to engage with.

22. The apparatus as claimed in claim 20 wherein the two handles comprise grip elements configured to minimize slippage and lift-off of the user's hands.

23. The apparatus as claimed in claim 20 further comprising a controller for controlling a visual display and/or resistance imparted by resistance means.

24. The apparatus as claimed in claim 1 wherein the first and second actuating rods are configured such that a direction of displacement by the user is in a plane perpendicular to a longitudinal axis of the crank shaft.

25. The apparatus as claimed in claim 1 further comprising display screen.

26. The exercise apparatus as claimed in claim 1 wherein movement of the free ends of the first and second actuating rods is elliptical and are in phase.

27. An apparatus for exercising comprising:

a base and a frame;

a first crank rotatably mounted on a crank shaft mounted on the frame, said first crank connected to first and second actuating rods;

the first crank connected to the first actuating rod via a first coupling rotatably mounted to the first crank;

each of said first and second actuating rods being slidably mounted at one end via a coupling pivotally mounted to the frame and having a free end configured for a user to grip;

said first and second actuating rods being in phase with one another such that they follow parallel paths of movement simultaneously during use; and wherein the apparatus further comprises displacement means for controlling the position of the first and second actuating rods before, during and/or after use.

28. The apparatus as claimed in claim 27 wherein the displacement means comprises a motor operatively connected to the first and second actuating rods for controlling their position before, during and/or after use.

* * * * *